US005350311A

United States Patent [19]

Roy et al.

[11] Patent Number: 5,350,311

[45] Date of Patent: Sep. 27, 1994

[54] SEAL FOR AN AUTOMOTIVE ELECTRICAL CONNECTOR ASSEMBLY

[75] Inventors: Dhirendra C. Roy, Canton; Zenon Hotra, Troy, both of Mich.

[73] Assignee: United Technologies Automotive, Inc., Dearborn, Mich.

[21] Appl. No.: 100,503

[22] Filed: Jul. 30, 1993

[51] Int. Cl.[5] ..... H01R 13/52

[52] U.S. Cl. ..... 439/273; 439/272

[58] Field of Search ..... 439/271–283, 439/587

[56] References Cited

U.S. PATENT DOCUMENTS

| | | | |
|---|---|---|---|
| 3,947,959 | 4/1976 | DuRocher . | |
| 3,976,352 | 8/1976 | Spinner | 439/272 |
| 4,588,248 | 5/1986 | Moore | 439/272 |
| 4,717,359 | 1/1988 | Rahrig et al. . | |
| 4,820,181 | 4/1989 | Kuzuno et al. | 439/272 |
| 5,037,307 | 8/1991 | Ogasawara | 439/272 |
| 5,256,083 | 10/1993 | Yamomoto | 439/595 |

*Primary Examiner*—David L. Pirlot

*Attorney, Agent, or Firm*—Harness, Dickey & Pierce

[57] ABSTRACT

A sealing member of the present invention is used in an automotive vehicle electrical connector assembly and has a pentagonal cross sectional shape thereto with an inside surface defining an aperture centrally therein. A first electrical connector half has an electrical contact proximate therewith and is surrounded by a support structure. A second electrical connector half has an electrical contact proximate therewith and has a body segment and a mating segment within which extends an outer peripheral wall. Furthermore, the second connector half outer peripheral wall has an outside surface and an inside surface which are joined by a peripheral edge therearound. The sealing member is juxtapositioned between the inside surface of the second connector half and the outside surface of the first connector half supporting structure.

16 Claims, 1 Drawing Sheet

SEAL FOR AN AUTOMOTIVE ELECTRICAL CONNECTOR ASSEMBLY

BACKGROUND OF THE INVENTION

This invention relates generally to electrical connector assemblies for use in automotive vehicles and specifically to a seal contained therein.

In electrical systems for automotive vehicles it is common to have a pair of electrical connector halves which are mated together to electrically join two distinct wire harnesses. These electrical connector assemblies are often subjected to harsh field conditions during normal vehicle use. This is especially true when these connectors are located within a vehicle engine compartment where they are exposed to water vapor, splashing water, dust and other contaminating substances. Accordingly, the connector halves must have an effective seal located therebetween to isolate the electrical contacts contained therein from being vulnerable to these disruptive environmental conditions.

One conventional seal construction consists of an O-ring with a circular cross sectional shape. This O-ring is typically seated in a groove incorporated within a side wall of a connector half. This groove often causes a die lock molding condition for the connector half thereby necessitating complicated tools or secondary sonic welding-type operations to manufacture such. A second traditional seal configuration places an O-ring between a projecting end of a connector half and an adjoining shoulder of another connector half; this forms a butt seal. In the butt seal construction it is difficult, without additional effort, to retain the seal upon the projecting end prior to mating with the other connector half.

A third conventional style consists of a substantially annular seal having a cross sectional shape being defined by an elongated rectangle with a plurality of staggered semi-circular protrusions extending oppositely therefrom. This design does not require grooves to be molded within either of the connector halves. While this latter seal is more effective than the prior constructions, the specific cross sectional shape is complex and therefore requires expensive tooling. Moreover, this latter construction creates problems during mating of the connector halves. They are susceptible to buckling and possible shearing along the semicircular projections of the seal. Therefore, a seal is desired which has improved sealing ability, allows for low effort mating of the connector halves, and is suitable for low cost manufacturing.

SUMMARY OF THE INVENTION

In accordance with the present invention, the preferred embodiment of a new and useful sealing member for an automotive vehicle electrical connector assembly has a pentagonal cross sectional shape thereto with an inside surface defining an aperture centrally therein. A first electrical connector half has an electrical contact proximate therewith which is substantially surrounded by an inner support structure. A second electrical connector half has a corresponding mating electrical contact proximate therewith and has a body segment and a mating segment within which extends an outer peripheral wall. Furthermore, the second connector half outer peripheral wall has an outside surface and an inside surface which are joined by a peripheral edge therearound. The sealing member is juxtapositioned between the inside surface of the second connector half and the outside surface of the first connector half supporting structure.

The present invention is advantageous over the prior art in that the pentagonal cross sectional shape minimizes the material required to produce the sealing member while maximizing the interference between the sealing member and the adjacent connector halves, thereby improving the seal created therebetween. This improved seal significantly reduces the ability of water vapor to reach the electrical contacts thereby creating a "flash proof" connector assembly. Furthermore, the angular faces of the sealing member provide for low effort assembly of the first and second connector halves. Moreover, the specific pentagonal cross sectional shape of the sealing member allows for low cost tooling and manufacture since the typical cross sectional shape is open to the normal die line of draw.

Additional advantages and features of the present invention will become apparent from the following description and appended claims, taken in conjunction with the accompanying drawings.

DETAILED DESCRIPTION OF THE PREFERRED EMBODIMENT

Figure 1:
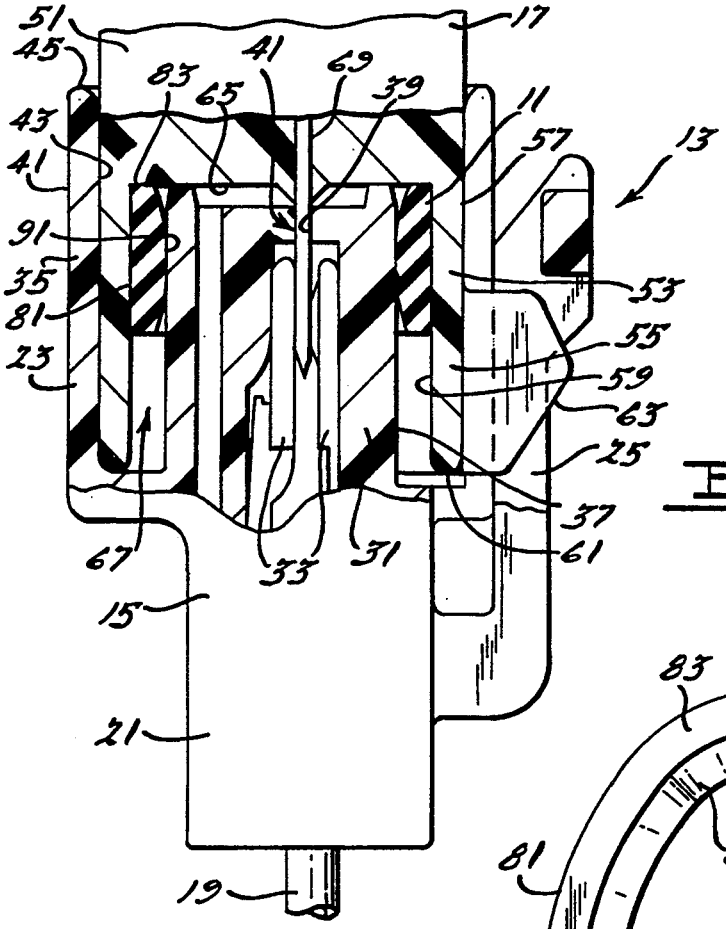
FIG. 1 is a side elevational view showing a preferred embodiment of an electrical connector assembly having a sealing member of the present invention therein.

Referring to FIG. 1, the preferred embodiment of a sealing member 11 of the present invention is used in an electrical connector assembly 13 for an automotive vehicle electrical system. Electrical connector assembly 13 is further comprised of a first connector half 15 and a second connector half 17 which serve to electrically connect two or more electricity carrying members or wire harnesses 19 together.

First connector half 15 is comprised of a body segment 21 and a mating segment 23. Body segment 21 has provisions therein for receiving and retaining wire harness 19. Furthermore, a cantilevered arm 25 projects from a portion of body 21. Mating segment 23 of first connector half 15 comprises an inner support structure 31, a pair of electrical contacts 33 and an outer peripheral wall 35. Support structure 31 projects outward from body 21 and is adapted for retaining electrical contacts 33 centrally therewithin. Support structure 31 further has an outer surface 37 which is substantially elliptical when viewed from an end thereof and also has an inside surface 39 which defines a passage 41 therethrough. Peripheral wall 35 of first connector half 15 is defined by an elliptical outer surface 41 and a congruent inner surface 43, both of which are bordered by a slightly tapered end 45.

Second connector half 17 comprises a body segment 51 and a mating segment 53 extending therefrom. Body segment 51 has provisions therein for receiving and retaining a wire harness (not shown). Mating segment 53 of second connector half 17 has an outer peripheral wall 55 defined by an outside surface 57 and an inside surface 59, both of which are bordered by a peripheral edge 61. A fin-like locking tab 63 projects from a portion of outside surface 57 and is coincident with cantilevered arm 25 of first connector half 15, thereby providing for a locking interface. Outside surface 57 and inside surface 59 of second connector half 17 are substantially elliptical in shape when viewed from an end thereof. Moreover, inside surface 59 intersects body 51 of second connector half 17 at a shoulder 65. Inside surface 59 and shoulder 65 define a cavity 67 within which an electrical contact 69 extends. Outside surface 57 of second connector half 17 is constructed to fit snugly within peripheral wall 35 of first connector half 15.

Figure 2:
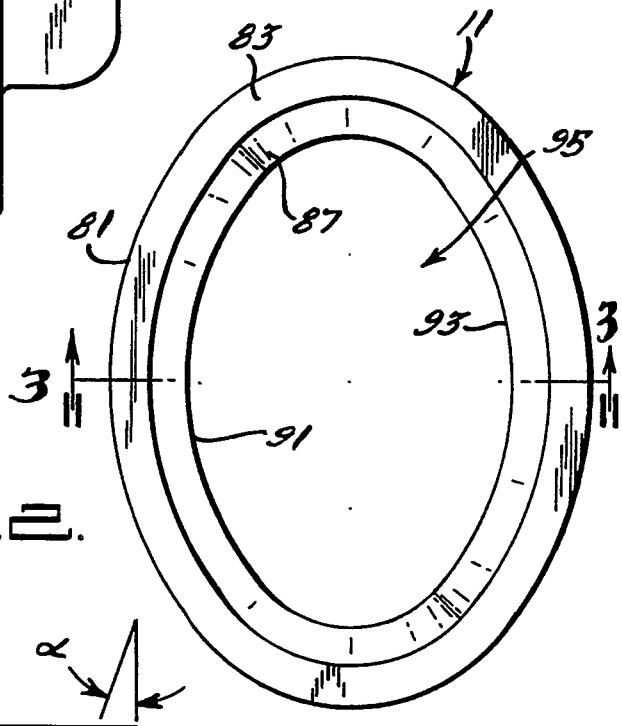
FIG. 2 is an end elevational view of the present invention sealing member of FIG. 1.
Figure 3:
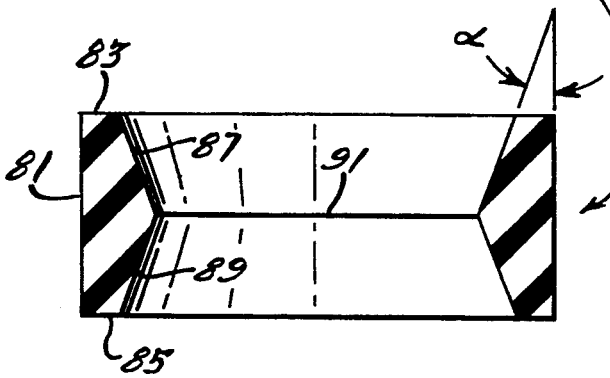
FIG. 3 is a cross sectional view of the present invention sealing member, taken along line 3—3 from FIG. 2.

Referring to FIGS. 2 and 3, sealing member 11 has an elongated annular configuration. Sealing member 11 further has a pentagonal cross sectional shape comprised of a base wall 81, a pair of end walls 83 and 85, and a pair of angular faces 87 and 89. Angular faces intersect one another at a peaked segment 91. In the preferred embodiment, faces 87 and 89 and peaked segment 91 create an inside surface 93 which defines an aperture 95 therethrough. An angle $\alpha$ is created between each angular face 87 and 89 and the adjacent portion of a plane defined by base wall 81. It has been found that angles $\alpha$ are most effective when within fifteen to thirty degrees and are preferably twenty-five degrees. Therefore, sealing member 11 is open to the line of draw about peaked segment 91 when produced by an injection molding process. Sealing member 11 is made from an elastomeric material such as silicon rubber or a PVC/Nitrile Butadiene blend.

Referring again to FIG. 1, sealing member 11 is juxtapositioned between support structure 31 of first connector half 15 and peripheral wall 55 of second connector half 17. In the preferred embodiment, sealing member 11 is externally guided into the second connector half 17 such that base wall 81 is adjacent to inside surface 59 of peripheral wall 55. Furthermore, end wall 83 of sealing member 11 is proximate with shoulder 65 of second connector half 17. Accordingly, when support structure 31 of first connector half 15 is inserted within cavity 67 of second connector half 17, peaked segment 91 of sealing member 11 is compressed thereagainst. This provides for a relatively increased surface area interference between sealing member 11 and connector halves 15 and 17, respectively, as compared to conventional methods. Moreover, angular faces 87 and 89 provide for low effort installation of first connector half 15 within second connector half 17. Therefore, water vapor, splashing water, dust and other contaminants are prevented from interfering with and degrading the performance of electrical contacts 33 and 69. In an alternative embodiment, sealing member 11 may be internally guided such that base wall 81 is adjacent to support structure 31 of first connector half 15 and peaked segment 91 is compressed by peripheral wall 55 of second connector half 17.

While the preferred embodiment of this sealing member for use in an automotive vehicle electrical connector assembly has been disclosed, it will be appreciated that various modifications may be made without departing from the present invention. For example, even though a substantially elliptical end view shape has been shown and described for the sealing member and connector halves, a variety of other circular or rectangular end view shapes may be used. Furthermore, connector halves having differing constructions can be used with the present invention sealing member without departing from this invention. Various materials have been disclosed in an exemplary fashion, however, a variety of other materials may of course be employed. It is intended by the following claims to cover these and any other departures from the disclosed embodiments which fall within the true spirit of this invention.

The invention claimed is:

1. An electrical connector assembly for an automotive vehicle comprising:

a first connector half having an electrical contact proximate therewith and being substantially surrounded by a support structure therearound, said support structure further having an outer surface thereof;

a second connector half having an electrical contact proximate therewith, said second connector half further having a body segment and a mating segment within which extends an outer peripheral wall having an outside surface, an inside surface and a peripheral edge therearound, said body segment of said second connector half having a shoulder thereon such that said inside surface of said mating portion intersects said body at said shoulder thereto; and a sealing member having a pentagonal cross sectional shape thereto with an inside surface defining an aperture centrally therein, said pentagonal cross sectional shape having a substantially straight base wall with a pair of relatively shorter end walls projecting therefrom and having a pair of angular faces extending therefrom, said pair of angular faces intersecting each other at a peaked segment, said inside surface of said second connector half peripheral wall and said outer surface of said first connector half supporting structure having said sealing member juxtapositioned therebetween such that said peaked segment is compressed therein.

2. The electrical connector assembly of claim 1 wherein:

said sealing member has an elongated annular shape thereof.

3. The electrical connector assembly of claim 1 wherein:

said sealing member is made from an elastomeric material.

4. The electrical connector assembly of claim 1 wherein:

said first connector half disengagably locks upon a portion of said second connector half.

5. The electrical connector assembly of claim 1 wherein:

said shoulder of said second connector half has one of said pair of end walls of said sealing member adjacent thereto.

6. The electrical connector assembly of claim 5 wherein:

said inside surface of said second connector half has said base wall of said sealing member proximate therewith; and said outer surface of said first connector half support structure has said peaked segment of said sealing member coincident therewith such that said peaked segment of said sealing member is compressed thereagainst.

7. The electrical connector assembly of claim 6 wherein:

said inner surface of said second connector half externally guides said sealing member during installation of said connector halves.

8. The electrical connector assembly of claim 5 wherein:

said outer surface of said first connector half support structure has said base wall of said sealing member proximate therewith; and said inside surface of said second connector half has said peaked segment of said sealing member coincident therewith such that said peaked segment of said sealing member is compressed thereagainst.

9. The electrical connector assembly of claim 8 wherein:

said outer surface of said first connector half support structure internally guides said sealing member during installation of said connector halves.

10. The electrical connector assembly of claim 1 wherein:

said sealing member has a plane defined by said base wall and each of said pair of angular faces thereby forming a pair of predetermined angles therebetween, said predetermined angles each are symmetrical with one another.

11. The electrical connector assembly of claim 10 wherein:

said pair of predetermined angles between said pair of angular faces and said base wall plane fall within a range of 15-30 degrees.

12. A seal for an automotive electrical connector assembly being comprised of:

a pentagonal cross sectional shape with an inside surface defining an aperture centrally therein, said pentagonal cross sectional shape having a substantially straight base wall with a pair of relatively shorter end walls projecting therefrom and having a pair of angular faces extending therefrom, said pair of angular faces intersecting each other at a peaked segment.

13. The seal of claim 12 wherein:

said seal has an elongated annular shape thereof.

14. The seal of claim 12 wherein:

said seal is made from an elastomeric material.

15. The seal of claim 12 wherein:

said seal has a plane defined by said base wall and each of said pair of angular faces thereby forming a pair of predetermined angles therebetween, said predetermined angles each are symmetrical with one another.

16. The seal of claim 15 wherein:

said pair of predetermined angles between said pair of angular faces and said base wall plane fall within a range of 15–30 degrees.

* * * * *